US008773274B2

(12) United States Patent
Licher

(10) Patent No.: US 8,773,274 B2
(45) Date of Patent: Jul. 8, 2014

(54) METERING APPARATUS WITH DAMAGE MONITORING

(75) Inventor: Burkhard Licher, Reiskirchen (DE)

(73) Assignee: Rovema GmbH (DE)

( * ) Notice: Subject to any disclaimer, the term of this patent is extended or adjusted under 35 U.S.C. 154(b) by 109 days.

(21) Appl. No.: 13/696,234

(22) PCT Filed: Apr. 28, 2011

(86) PCT No.: PCT/EP2011/056695
§ 371 (c)(1),
(2), (4) Date: Dec. 13, 2012

(87) PCT Pub. No.: WO2011/138208
PCT Pub. Date: Nov. 10, 2011

(65) Prior Publication Data

US 2013/0106612 A1 May 2, 2013

(30) Foreign Application Priority Data

May 6, 2010 (DE) ..... 10 2010 028 697

(51) Int. Cl.
*G08B 21/00* (2006.01)

(52) U.S. Cl.
USPC ..... 340/683; 340/665; 340/673; 340/680; 340/686.2; 340/686.3; 340/686.4; 340/6.1

(58) Field of Classification Search
CPC ..... B65D 83/0083; G01F 13/005; G05B 23/0264; G07F 17/0092; F41B 11/57; G01H 1/003; B01F 7/16; B07B 11/06
USPC ..... 340/665, 679–683, 686.2–686.4, 673, 340/6.5
See application file for complete search history.

(56) References Cited

U.S. PATENT DOCUMENTS 4,092,990 A * 6/1978 Bayne ..... 453/55
4,352,567 A * 10/1982 Guibert ..... 366/76.2
4,441,103 A * 4/1984 Urabe ..... 340/680

(Continued)

FOREIGN PATENT DOCUMENTS

DE 102 45 341 A1 4/2004
EP 1 270 417 A1 1/2003

OTHER PUBLICATIONS

International Search Report under date of mailing of Sep. 7, 2011 in connection with PCT/EP2011/056695.

(Continued)

*Primary Examiner* — Daniel Wu
*Assistant Examiner* — Son M Tang
(74) *Attorney, Agent, or Firm* — Quarles & Brady LLP

(57) ABSTRACT

Packaging installation with a metering apparatus and method for monitoring damage in a packaging installation in which packs (19) which are to be filled can be charged with the contents in each case by means of a metering apparatus (01) designed according to one of Claims 1 to 8, wherein —the vibrations of the wall of the dispensing container (02) are measured at least during operation of the stirrer (06) and/or of the metering screw (05), —the measured values are evaluated by the vibration evaluator (10), —deviations in the vibration behavior are detected and compared with limit values stored in the vibration evaluator (10), —when the limit values are exceeded, this indicates with sufficient probability, that the stirrer (06) or the metering screw (05) is in contact with the dispensing container (02), —an alarm is triggered by means of the vibration evaluator (10).

15 Claims, 1 Drawing Sheet

(56) References Cited

U.S. PATENT DOCUMENTS

| | | | | |
|---|---|---|---|---|
| 4,490,046 | A * | 12/1984 | Guibert | 366/76.4 |
| 4,895,274 | A * | 1/1990 | Morimoto et al. | 222/63 |
| 5,350,040 | A * | 9/1994 | Gribble | 184/105.2 |
| 5,448,911 | A * | 9/1995 | Mason | 73/152.47 |
| 5,485,752 | A * | 1/1996 | Asano et al. | 73/660 |
| 6,340,036 | B1 | 1/2002 | Toyoizumi et al. | |
| 6,789,661 | B2 * | 9/2004 | Davies et al. | 198/391 |
| 8,100,095 | B2 * | 1/2012 | McKnight et al. | 123/23 |
| 2003/0047076 | A1 * | 3/2003 | Liu | 95/282 |

OTHER PUBLICATIONS

English Translation of the International Preliminary Report on Patentability, PCT/EP2011/056695, Nov. 15, 2012.

* cited by examiner

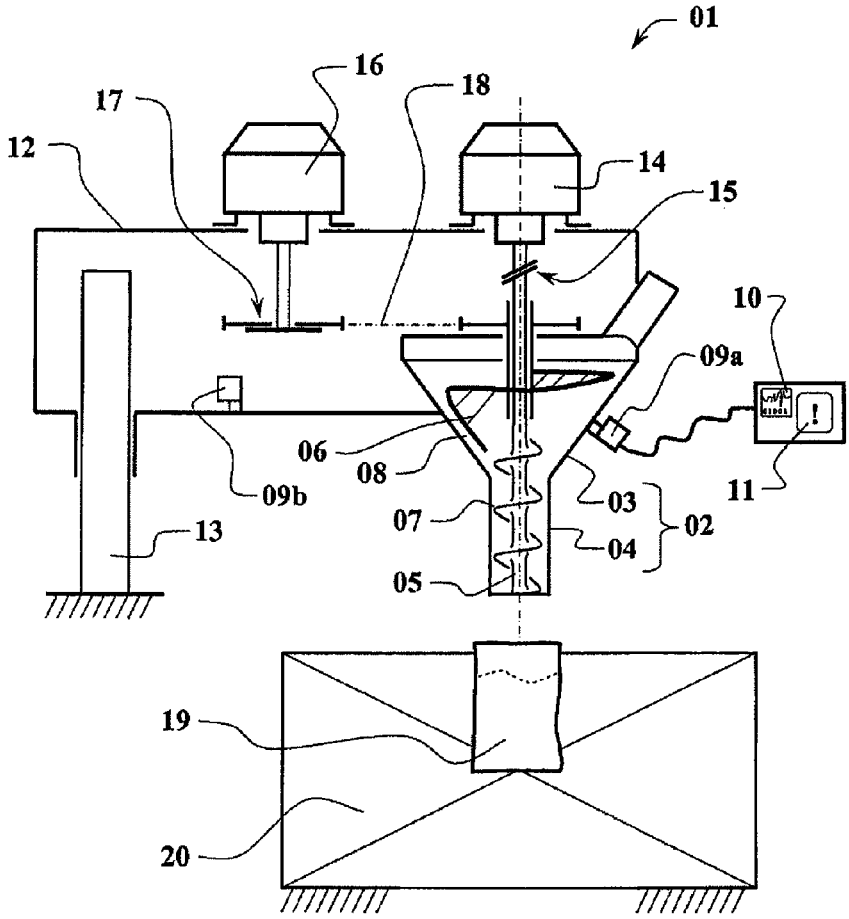
01
16
18
17
12
14
15
10
09a
06
08
09b
03
11
07
02
13
04
05
19
20

METERING APPARATUS WITH DAMAGE MONITORING

CROSS-REFERENCE TO RELATED APPLICATIONS

This application represents the national stage entry of PCT International Application No. PCT/EP2011/056695 filed on Apr. 28, 2011 and claims the benefit of German Patent Application No. 10 2010 028 697.4 filed May 6, 2010. The contents of both of these applications are hereby incorporated by reference as if set forth in their entirety herein.

The invention pertains to a metering apparatus that serves for metering free-flowing materials and is designed for being arranged on a packaging machine with damage monitoring.

Various metering apparatuses are known from the prior art. A metering apparatus that is arranged, in particular, on a packaging machine has the purpose of respectively delivering a certain amount of the material to be filled into a package supplied by the packaging machine. A screw-type metering apparatus is frequently utilized for realizing a fast and exact metering process. In this case, a funnel with an outlet, in which a metering screw is arranged, is situated above the package to be filled. This metering screw is switched on and off in cyclic intervals and therefore respectively delivers the quantity to be filled into the package.

In order to ensure a reliable material feed to the metering screw, a funnel, in which a supply of the corresponding material to be packaged is situated, is arranged upstream of the outlet. An agitator needs to be used in order to prevent the material from agglutinating in the funnel or from adhering to the edge of the funnel. It is advantageous to arrange the agitator centrally in the funnel in order to ensure optimal mixing of the funnel content and to prevent local accumulations.

Various agitator shapes are used in dependence on the material to be packaged. These agitator shapes depend on the desired mixing effect of the funnel content, as well as on the tendency of the material to adhere to the walls of the funnel. In order to ensure a constant material quality in the package, it is particularly important that no material deposits adhere to the funnel in order to eliminate the risk of such deposits sporadically separating and being delivered into individual packages.

In order to solve this problem, different approaches known from the prior art aim, in particular, to maintain the clearance between the agitator and the funnel as small as possible while preventing the agitator from contacting the funnel wall. In this respect, it needs to be taken into consideration, in particular, that the circulation of the material in the funnel causes the funnel to be slightly deformed such that the clearance between the funnel wall and the agitator may be locally reduced. Depending on the elasticity of the chosen agitator, it furthermore must be assumed that this agitator likewise is slightly bent in the direction of the funnel wall. Consequently, a corresponding safety clearance needs to be observed in order to ensure the required clearance and to preclude any contact between the agitator and the wall of the funnel.

However, this in turn is counterproductive to the desired effect of maintaining the wall of the funnel free of accumulations. This always represents a balancing act between the problem of risking contact and the possibility of allowing deposits to adhere to the wall.

It is absolutely imperative to prevent any contact between the agitator and the wall of the funnel, in particular, for the following reason: since the agitator has the function of preventing deposits from adhering to the funnel wall, the agitator usually has a predominantly pointed outer edge toward the funnel wall in the agitating direction. Scraping occurs if this edge comes in contact with the funnel wall, wherein material of the funnel wall may be scraped off. In accordance with the conventional choice of materials for the funnel and the agitator, this may lead to a contamination of the material to be packaged with metal chips. In most instances, however, it is absolutely imperative to prevent the material to be packaged from being contaminated with foreign material, particularly metal chips.

In this context, it must be taken into consideration that the slightest contamination of an individual packaging unit with a corresponding metal chip can already cause significant harm, particularly in the food industry. If this contamination is not detected until the product reaches the consumer, a complete batch that usually concerns an extended production run is typically recalled and destroyed.

In order to prevent corresponding losses, the clearance between the agitator and the funnel wall is in the prior art generally chosen such that it is generally impossible for an agitator to contact or touch the funnel wall.

In an effort to reduce the distance between the agitator and the container wall, it was attempted in the prior art to detect corresponding damages caused by a contact between the agitator and the wall of the funnel in a timely fashion. For this purpose, torque monitoring that already is common practice in the prior art for controlling the agitation process was simultaneously used for detecting a contact.

The torque monitoring of the agitator primarily serves for monitoring the filling level, as well as the consistency of the material to be packaged. In this case, the required driving energy is continuously controlled during the agitation process. Information on the content of the funnel can be obtained from variations in the agitation process or in the drive.

Due to the registration of the required driving energy for the agitator, it is likewise possible to diagnose a contact between the agitator and the wall of the funnel in individual situations and applications. In this case, it is assumed that the torque increases due to such a contact. This method proved successful in individual instances and for individual specific materials.

However, it was determined that a contact between the agitator and the wall of the funnel cannot be detected in all instances by means of torque monitoring. This is the case, in particular, if the agitator torque is already high and fluctuates due to the material to be packaged. Slight deflections resulting from a contact are not reliably detected in such instances. In this respect, this method therefore is only suitable for diagnosing corresponding contacts between the agitator and the wall of the funnel in individual instances.

The present invention therefore is based on the objective of disclosing a damage detection method for a metering apparatus, by means of which a contact between the agitator and the wall of the funnel can be reliably detected regardless of the respective material to be packaged.

This objective is attained with the inventive metering apparatus according to Claim 1. A packaging system with a corresponding metering apparatus is disclosed in Claim 8. An advantageous method for this purpose is defined in Claim 10.

Advantageous embodiments form the objects of the dependent claims.

In the arrangement on a packaging machine, a metering apparatus serves for metering free-flowing products. The corresponding metering apparatus is used, in particular, on a tubular bag or a bag forming, filling and sealing machine. In this case, the metering apparatus features a delivery container that consists of a funnel and a tube. An agitator is arranged, in particular, centrally within the funnel. Furthermore, a metering screw is respectively arranged in the funnel or in the delivery container. The funnel and the tube usually have a common centre axis. In this respect, the tube is situated underneath the funnel. However, it would likewise be possible that the tube laterally extends out of the funnel bottom. The funnel primarily serves for accommodating a material volume required for carrying out the corresponding metering process without interruption. Consequently, the size of the funnel primarily depends on the respective volume to be packaged, as well as the material feed to the funnel of the metering apparatus. The length of the tube is defined, in particular, with respect to ensuring the function of delivering a respectively defined volume of the material to be packaged to the packaging machine. It may occasionally suffice, in particular, if the tube has a very short length in relation to its diameter.

The inventive metering apparatus is characterized by the utilization of a vibration sensor, as well as a vibration evaluator. If the agitator and/or the metering screw contact the delivery container, a change in the mode of vibration occurs in the wall of the delivery container. This change can be measured by means of the vibration sensor and the corresponding measured values can in turn be evaluated by means of the vibration evaluator in order to detect deviations. It is therefore possible to detect a contact between the agitator or the metering screw and the delivery container by means of the vibration sensor and the vibration evaluator.

The inventive idea of utilizing a vibration sensor is based, in particular, on the realization that the delivery container is, when the agitator contacts the wall of the delivery container, excited with a vibration that significantly differs from the mode of vibration during the normal operation. This is based on the realization, in particular, that the normal mode of vibration is dampened by the material to be packaged during the operation of the metering apparatus and preferably is a uniform mode. In accordance with its function, the agitator, as well as the delivery container, usually has a preferably high rigidity. Due to this high rigidity, a contact of the moving agitator with the wall of the delivery container results in a significantly different mode of vibration in the wall of the delivery container. It can be expected, in particular, that the resulting frequencies lie in the higher frequency ranges although they have a lower amplitude.

In a preferred embodiment, it is ensured that external sources of excitation do not lead to the triggering of a signal in the vibration evaluator. This concerns, in particular, the excitation by the drives, any existing gear mechanisms and possible clutch actuation and shifting processes that likewise can introduce collisional excitations into the delivery container. In this respect, it would be possible, e.g. during a shifting process, to inform the vibration evaluator of the shifting process such that this shifting process is not misinterpreted.

A particularly advantageous operation of the inventive metering apparatus is achieved if the vibration evaluator comprises or activates an alarm device, wherein an acoustical and/or optical warning can be output when a contact is detected. The output of a corresponding contact event is appropriate with respect to the vibration evaluator function of detecting a contact between the agitator and the wall of the delivery container. Consequently, only the warning being output may cause the system supervisor to take measures for handling the alarm scenario. Although it would be possible to control the packaging system in such a way that the material is automatically discarded without triggering an alarm when a contact is detected, it is still advantageous to inform the system supervisor of a corresponding event.

In a preferred application, the clearance between the agitator and/or the metering screw and the inner wall of the funnel and/or the tube is at least at one point smaller than 20 mm. The smallest distance possible from the wall of the delivery container is required with respect to the agitator function of preventing a material deposit from adhering to the funnel wall, as well as the metering screw function of delivering corresponding material in a controlled fashion. This distance depends, in particular, on the respective type of material to be packaged. This distance therefore is usually less than 5 mm and requires, in particular, the inventive damage monitoring.

The funnel, particularly the delivery container, is preferably made of metal, particularly of special steel. The corresponding choice of material, particularly special steel, is especially advantageous with respect to the stability and the service life during the general utilization of the metering apparatus, as well as, in particular, with respect to applications, in which the detection of modes of vibration is relevant. Due to the high modulus of elasticity of metal, particularly special steel, intermittent excitations by the agitator lead to characteristic modes of vibration that accordingly are easier to detect.

In a special embodiment, the vibration sensor is, according to the invention, coupled to the delivery container in such a way that vibrations in the wall of the funnel and/or the tube are transmitted to the vibration sensor.

With respect to the vibration sensor function of measuring and forwarding corresponding modes of vibration in the wall of the funnel, it is necessary to make the corresponding vibrations accessible to the vibration sensor. In this respect, it is advantageous to produce a physical connection between the wall of the funnel and the vibration sensor. This can be realized by directly attaching the vibration sensor to the wall of the funnel or the tube, respectively. It is likewise possible to position the vibration sensor on objects that are solidly connected to the delivery container, e.g. on braces. In this context, it is important that the position of the vibration sensor is not vibrationally decoupled from the delivery container. It is also important that the least damping possible of vibrations occurs between the wall of the delivery container and the vibration sensor.

In the implementation of the inventive solution, it is advantageous to choose a vibration sensor with one measuring axis, wherein accelerations below 200 g, particularly in the measuring range below 50 g, can be registered in the one measuring axis.

It is furthermore advantageous to choose a vibration sensor that can register frequencies from at least 5 Hz, particularly from 0.1 Hz, up to at least 200 Hz, particularly up to at least 5000 Hz. Due to the choice of an advantageous frequency spectrum of the vibration sensor, it is advantageously possible to generally detect a contact of the agitator with the wall of the funnel in the mode of vibration of the funnel.

The evaluation of the measuring result of the vibration sensor can be realized in a particularly advantageous fashion if the vibration sensor has a spectral resolution<5 Hz, particularly <2 Hz. Due to the accuracy of the vibration sensor, it is possible, in particular, to respectively distinguish the modes of vibration during a contact between the agitator and the wall of the delivery container from general modes of vibration in the delivery container and external sources of excitation such as motors, gear mechanisms or clutches.

The objective of the invention is furthermore attained with an inventive packaging system that features a metering apparatus according to the preceding description. In this case, the packaging system features a control device that initiates advantageous control or adjustment processes when an alarm is triggered.

Although the triggering of an alarm is already advantageous for the system supervisor, an optimal damage reduction can only be achieved if the packaging system also reacts to the alarm scenario. It is therefore ensured that the corresponding package does not go on sale.

In a preferred embodiment, the packaging system is stopped by the control device when an alarm is triggered. Consequently, the machine operator is able to remove the package being filled at the time and, for safety reasons, also the previously filled packages from the system such that they are prevented from going on sale. The system supervisor furthermore is able to control the metering apparatus and to initiate corresponding measures if it is determined that the metering apparatus is defective and requires attention.

If the packaging system is not stopped or material cannot be readily removed from the packaging system, it is particularly advantageous to ensure material tracking for the packages being filled at the time the alarm is triggered. Consequently, the filled packages can be detected in the following process during their additional transport and reliably removed from the material flow. It is therefore also ensured that corresponding packages do not go on sale.

For this purpose, the packaging system is advantageously realized in such a way that filled packages that are potentially contaminated with metal chips or the like can be separately removed from the packaging system. This concerns, in particular, the period between the triggering of the alarm and the cancelling of the alarm by the system supervisor or by an automatic control. The separate removal of corresponding packages from the packaging system can be ensured by providing a structurally separated material removal station upstream of the end of the material flow in the packaging system.

The solution therefore results in a supplementary inventive method for monitoring damage in a packaging system. In this case, the packaging system is equipped with a metering apparatus according to one of the advantageous embodiments described above, by means of which the packages are filled with the respective material. The vibrations of the wall of the delivery container are measured at least during the operation of the agitator and/or the metering screw. These measured values are subsequently evaluated by the vibration evaluator. The vibration evaluator in turn is able to detect and compare deviations in the vibration characteristics with stored limiting values. If the limiting values are exceeded, it can be concluded with sufficient probability that the agitator or the metering screw has contacted the delivery container. An alarm is subsequently triggered by means of the vibration evaluator.

The inventive method now makes it possible to reliably detect contacts between the agitator and the delivery container. Consequently, a contamination of the material to be packaged or the package with foreign matter due to a contact between the agitator and the funnel or between the metering screw and the tube can be reliably precluded during the operation of the packaging machine. The damage scenario of allowing packages contaminated, e.g., with metal chips to go on sale, which should be prevented in all instances, therefore is reliably precluded. This method likewise makes it possible to reduce the clearance between the agitator and the wall of the delivery container because it is now ensured that an inadvertent contact is detected. Consequently, the product quality can also be improved because material deposits adhering to the wall of the delivery container respectively can be further reduced or precluded.

When an alarm is triggered, this alarm is advantageously output acoustically and/or optically for the system supervisor. The system supervisor therefore is able to appropriately react to the situation.

In this method, the metering apparatus, particularly the packaging machine, furthermore is advantageously stopped when an alarm is triggered by the vibration evaluator.

In an alternative embodiment, the method is advantageously expanded to the effect that, when an alarm is triggered by the vibration evaluator, material tracking is carried out for the package being filled at the time the alarm is triggered and, in particular, all following packages until the alarm in the packaging system is cancelled. After the additional transport of the corresponding material flow, these packages are separately removed from the packaging system.

An inventive metering apparatus is schematically illustrated in an exemplary fashion in the following FIGURE.

In this schematic illustration,

FIG. 1 shows a schematic representation of an example of an inventive metering apparatus 01 of a packaging machine 20.

FIG. 1 schematically shows a metering apparatus 01 that is arranged on a packaging machine 20 and serves for elucidating the inventive solution in an exemplary fashion. In this case, the metering apparatus 01 features a delivery container 02 that consists of a funnel 03 and a tube 04 connected thereto. The agitator 06 and the metering screw are arranged therein. According to the schematic representation, the funnel 03 and the tube 04, as well as the agitator 06 and the metering screw 05, have a common centre axis.

A local minimal gap 08 exists between the agitator 06 and the funnel 03. This gap is chosen as small as possible in accordance with the function of the agitator, but sufficiently large for preventing a contact between the agitator 06 and the funnel 03, i.e., for preventing the gap 08 from assuming the value zero. This applies analogously to the gap 07 between the tube 04 and the metering screw 05.

However, a collision cannot be precluded when choosing a small gap 07 or 08. In this case, it can be expected that material is scraped off, particularly by the agitator 06 on the funnel wall 03, and that this material is transported into the package 19 to be filled.

In order to reliably detect such a damage scenario, the invention proposes to arrange a respective vibration sensor 09*a* or 09*b*, as well as a vibration evaluator 10, on the metering apparatus. In a particularly advantageous first solution, the vibration sensor 09*a* is directly attached to the funnel wall 03. However, it would alternatively also be possible to arrange the vibration sensor 09*b* at a location that is solidly connected to the delivery container such as, e.g., a frame 12 of the metering apparatus. In this respect, it needs to be observed that no excessive vibration damping occurs between the funnel 03 and the position of the vibration sensor 09*b*.

The vibration evaluator 10 may be arranged at a remote location referred to the metering apparatus 01. In this respect, only the IT connection between the vibration sensor 09 and the vibration evaluator 10 is required. Consequently, it is easily possible to integrate the function of the vibration evaluator 10 into a control of the packaging system.

In the schematically illustrated example, a display 11 that can optically inform persons of an alarm is assigned to the vibration evaluator 10. This display may likewise be directly integrated into the metering apparatus 01, as well as into the control of the packaging system.

At least one drive 14 is required for the metering screw 05. Metering apparatuses 01 usually feature separate drives 14, 16 for the metering screw 05 and the agitator 06 as schematically illustrated in FIGURE. In this case, clutches 15 and 17 may be arranged between the respective drive 14, 16 and the metering screw 05 and the agitator 07. Likewise, a gear mechanism 18 is usually also provided at least for the drive 16 of the agitator 06. These drives 14, 16, clutches 15, 17 and the gear mechanism 18 can introduce collisional excitations into the delivery container 02 via the mutual connection produced by means of the frame 12 of the metering apparatus 01. Due to the advantageous control of the vibration evaluator 10, these collisional excitations can be detected and a misinterpretation in the form of a contact therefore can be precluded.

The invention claimed is:

1. A metering apparatus for metering free-flowing materials arranged on a packaging machine, said metering apparatus comprising:

a delivery container having a funnel and a tube an agitator arranged in the funnel a metering screw arranged in the delivery container;

a vibration sensor sensing vibration of the delivery container; and a vibration evaluator, wherein a change in a vibration of the delivery container resulting from contact of at least one of the agitator and the metering screw with the delivery container is sensed by the vibration sensor and detected by the vibration evaluator.

2. The metering apparatus according to claim 1, including an alarm device, wherein the vibration evaluator activates the alarm device to output at least one of an acoustical warning and optical warning when contact between the delivery container and at least one of the agitator and the metering screw is detected.

3. The metering apparatus according to claim 1, in which a clearance between at least one of the agitator (06) and the metering screw and at least one of the inner wall of the funnel and the tube is at least at one point smaller than 20 mm.

4. The metering apparatus according to claim 1, in which the funnel is made of metal.

5. The metering apparatus according to claim 1, in which the vibration sensor is coupled to the delivery container in such a way that vibrations in a wall of at least one of the funnel and the tube are transmitted to the vibration sensor.

6. The metering apparatus according to claim 1, in which the vibration sensor has one measuring axis in the direction of which accelerations below 200 g can be registered.

7. The metering apparatus according to claim 1, in which the vibration sensor can register frequencies from at least 5 Hz up to at least 200 Hz.

8. The metering apparatus according to claim 1, in which spectral resolution of the vibration sensor is lower than 5 Hz.

9. A packaging system with a metering apparatus according to claim 1, in which a control device stops the packaging system when an alarm is triggered by the vibration evaluator.

10. The packaging system according to claim 9, in which the packages filled by the metering apparatus between the triggering of the alarm and cancelling of the alarm can be separately removed from the packaging system.

11. A packaging system with a metering apparatus according to claim 1, including an alarm triggered by the vibration evaluator, wherein when the alarm is triggered by the vibration evaluator, a control device ensures material tracking of packages being filled at the time the alarm is triggered.

12. A method for monitoring damage in a packaging system, in which packages are filled with material, said packaging system including the metering apparatus according to claim 1, said method comprising:

measuring vibrations of a wall of the delivery container using the vibration sensor;

using the vibration evaluator to evaluate the vibrations measured by the vibration sensor and detect deviations in vibration characteristics of the delivery container at least during operation of at least one of the agitator and the metering screw;

comparing the deviations with limiting values stored in the vibration evaluator, wherein the limiting values are set, such that deviations exceeding the limiting values indicate that the delivery container has contacted at least one of the agitator and the metering screw; and triggering an alarm when the deviations exceed the limiting values.

13. The method according to claim 12, in which the alarm is at least one of acoustically and optically output for a system supervisor.

14. The method according to claim 12, in which the packaging system is stopped when the alarm is triggered.

15. The method according to claim 12, in which, when the alarm is triggered, material tracking is carried out for the package being filled at the time the alarm is triggered and all following packages until the alarm in the packaging system is cancelled, wherein these packages filled while the alarm is triggered are separately removed from the packaging system.

* * * * *